US005459892A

United States Patent [19]

Wells et al.

[11] Patent Number: 5,459,892

[45] Date of Patent: Oct. 24, 1995

[54] TRIPLE BEAM FRAME

[75] Inventors: Thomas J. Wells; Steven E. Ogle, both of Carthage, Mo.; Alvin R. Klancnik, Park Ridge, Ill.

[73] Assignee: L&P Property Management Company, Chicago, Ill.

[21] Appl. No.: 324,588

[22] Filed: Oct. 18, 1994

Related U.S. Application Data

[63] Continuation-in-part of Ser. No. 91,964, Jul. 15, 1993, abandoned.

[51] Int. Cl.[6] ..... A47C 23/05

[52] U.S. Cl. ..... 5/200.1; 5/239; 5/246; 5/263

[58] Field of Search ..... 5/200.1, 236.1, 5/239, 246, 247, 248, 255, 263

[56] References Cited

U.S. PATENT DOCUMENTS

| | | | |
|---|---|---|---|
| 272,076 | 2/1883 | Mueller . | |
| 651,928 | 6/1900 | Newman . | |
| 2,321,817 | 6/1943 | Hutton . | |
| 2,432,361 | 12/1947 | Winters . | |
| 2,890,464 | 6/1959 | Frey . | |
| 3,680,157 | 8/1972 | Slominski et al. | 5/247 |
| 3,755,833 | 9/1973 | Slominski | 5/247 |
| 3,938,204 | 2/1976 | Slominski | 5/255 |
| 3,992,732 | 11/1976 | Cervisi | 5/263 |
| 4,012,801 | 3/1977 | King et al. | 5/247 |
| 4,100,631 | 7/1978 | Slone | 5/247 |
| 4,120,058 | 10/1978 | Kitchen et al. | 5/247 |
| 4,129,908 | 12/1978 | Wagner | 5/247 |
| 4,218,790 | 8/1980 | Mizelle | 5/247 |
| 4,866,798 | 9/1989 | Harris | 5/263 |

*Primary Examiner*—Alexander Grosz
*Attorney, Agent, or Firm*—Wood, Herron & Evans

[57] ABSTRACT

A box spring assembly for use as a foundation for a bedding mattress has a triple beam frame. The frame has three layers of which the bottom layer consists of longitudinal side rails equally spaced from a center rail and connected at each end to a double thickness end rail consisting of a lower and upper board. The middle layer of the frame includes a number of transverse slats equally spaced between the upper board end rails positioned at each lengthwise end of the box spring assembly. The lower board end rails underlie the upper board end rails and are in the bottom plane of the frame. The top layer of the frame consists of longitudinal slats spaced atop the transverse slats and upper board end rails. The triple beam frame is constructed of metal, wood, or a combination thereof. Coil springs are secured to the longitudinal slats in the box spring assembly. The longitudinal slats provide additional support and resistance to bending or deformation at the foot and head end of the box spring assembly, particularly if the foot end of the bed is unsupported by the bed frame. The provision of the longitudinal slats in a third layer of the wooden frame also provides a higher profile for the box spring assembly.

11 Claims, 2 Drawing Sheets

TRIPLE BEAM FRAME

This application is a Continuation-In-Part of U.S. patent application Ser. No. 08/091,964 filed Jul. 15, 1993, now abandoned.

BACKGROUND OF THE INVENTION

This invention relates to bedding, and more particularly, to bedding foundations or so-called "box springs" for use in the support of bedding mattresses.

The desirability of a firm and yet resilient surface for sleeping or reclining has generated many improvements in the structure of mattresses in order to provide such a surface. The underlying foundation unit, or so-called "box spring", also contributes significantly to the firmness and resiliency characteristics of the mattress sleeping surface.

Conventionally, bedding foundations or box springs are formed with a wooden rectangular frame positioned at the bottom of the box spring. The wooden frame includes a series of cross rails or transverse slats extending laterally across the wooden frame. Coil springs are provided in the box spring and are secured at their lower ends to these transverse slats and the upper portion of the torsion spring supports the upper surface of the box spring. A pad is typically applied over the top of the coil springs and a fabric cover is placed over the padding to extend downwardly along the side of the box spring to be secured to the bottom wooden frame. The upper surface of the box spring typically includes a wire grid which underlies the pad and is secured to the top ends of the torsion springs.

The box spring is typically supported in a bed either on the conventional bed frame or in a metal angle iron frame, or so-called Hollywood bed frame, to which a headboard is attached. The mattress is positioned atop the box spring to provide a sleeping or reclining surface.

A problem associated with the typical box spring assemblies described hereinabove is the lack of support around the border regions of the foundation unit. Specifically, the common practice of sitting on the end of the bed results in the deformation of the mattress and underlying box spring which over time can result in an indentation or sagging of the mattress and box spring at the lengthwise end of the bed. This problem results from insufficient border support of the box spring assembly at the lengthwise end of the bed.

A further problem of the box spring assemblies described hereinabove results from the use of the angle iron or Hollywood bed frame in combination with the box spring and mattress. Typically, the Hollywood bed frame is shorter in length than the box spring and mattress resulting in an overhang of the box spring at the foot end of the bed. The Hollywood bed frame offers inadequate end support to the box spring and mattress combination at the lengthwise end of the bed. The portion of the box spring and mattress overhanging the Hollywood bed frame is unsupported thereby resulting in increased wear and deformation of the mattress and box spring at the lengthwise end of the bed and a tendency for the box spring and mattress to tilt or tip when one applies pressure or sits on the end of the bed.

SUMMARY OF THE INVENTION

The principal objective of the present invention has been to provide a box spring assembly which offers added border edge support at the longitudinal end of the bed.

A further objective of the invention has been to provide a box spring of increased height or profile which can be produced both economically and efficiently for use within the highly competitive bedding industry.

A still further objective of the invention has been to provide a box spring of increased strength and rigidity which is still relatively lightweight and inexpensive.

The objectives of the present invention have been obtained by a box spring assembly having a triple beam frame. A triple beam frame has three layers of frame members. The bottom layer consists of a generally rectangular wooden frame with a pair of spaced longitudinal end rails connected by a lower board in a double thickness end rail transversely oriented at each end of the end rails. A center support rail extends longitudinally and parallel to the side rails to provide additional support to the center portion of the box spring.

The middle layer of the triple beam frame consists of an upper board of the pair of end rails extending laterally in the box spring. The upper board of each end rail rests atop the lower board of each end rail. Three equally spaced transverse slats extend laterally between the end rails in the middle layer of the triple beam frame atop the side rails. The transverse slats provide the required lateral support and stiffness for the box spring. In one presently preferred embodiment, the three equally spaced transverse slats are wood and in other presently preferred embodiments they are metal or composite channels.

The upper most layer of the triple beam frame consists of eight spaced longitudinal wooden slats. The eight longitudinal slats are positioned atop of and perpendicular to the end rails and transverse slats of the frame. The advantages of the longitudinal slats within the frame of the box spring assembly include a stiffer box spring and to provide more support at each longitudinal end than previously known box spring frames. This border edge support at each end of the bed provides added resiliency and resistance to deformation when one sits on the end of the bed, as is a common practice. The added support at each lengthwise end of the box spring provided by the longitudinal slats increases the life of both the box spring and mattress by reducing the tendency for an indentation or sagging area to develop over time as a result of one sitting on the edge of the bed.

Additionally, a third layer in the frame of the box spring increases the height or profile of the box spring assembly by approximately three-fourths of an inch. This increased profile is advantageous in the competitive bedding industry in that the consumer demand for higher profile box springs and mattresses has increased.

Another advantage of the longitudinal slats in the upper layer of the frame in the box spring assembly of the present invention is the added support and resistance to bending at the lengthwise end of the box spring when supported on a Hollywood bed frame. Typically, a Hollywood bed frame is shorter than the box spring and mattress. Therefore, a portion of the box spring and mattress extends beyond the Hollywood bed frame, typically at the longitudinal foot end. The longitudinal slats of the triple beam frame provide increased support at the unsupported longitudinal end thereby enabling one to use a Hollywood bed frame without sacrificing the longitudinal end border support or risking the tipping or tilting of the bed.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
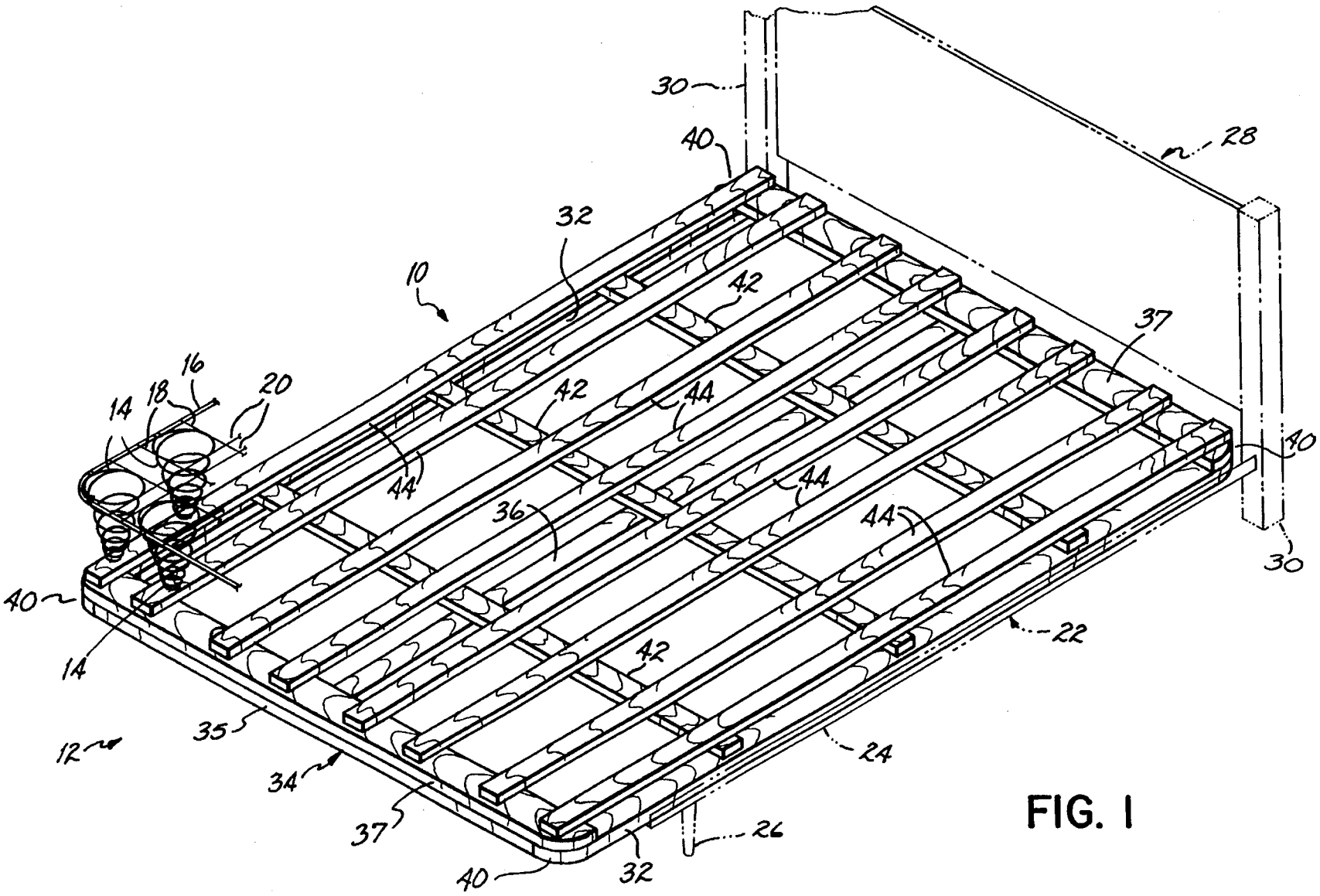
FIG. 1 is a perspective view of a first embodiment of the triple beam frame incorporated to a box spring assembly and positioned on a Hollywood-type bed frame in which the triple beam frame is wooden.

Referring to FIG. 1, a triple beam frame 10 of a box spring assembly 12 is shown. The generally rectangular frame 10 is incorporated into the box spring assembly 12 as the bottom portion thereof to which a plurality of coil springs 14 are stapled, nailed, or otherwise secured to the top of the frame 10. A border edge wire 16 extends around the upper periphery of the box spring assembly 12 and is clamped or otherwise secured to the upper most portion of coil springs 14 on the outer edges of the frame 10. A plurality of interconnecting transverse and longitudinal wires 18,20 join the top edges of the coil springs 14 on the interior of the box spring assembly 12. The transverse and longitudinal wires 18,20 of the box spring 12 are clamped, welded, or otherwise secured to the border edge wire 16. A pad or upholstered cover (not shown) is provided as the top of the box spring assembly 12 and extends downwardly from the upper portion of the box spring assembly 12 to be tacked or otherwise secured to the triple beam frame 10 at the bottom of the box spring assembly 12.

The triple beam frame 10 and box spring assembly 12 is shown supported on a Hollywood-type bed frame 22 in FIG. 1. The bed frame 22 supports the triple beam frame 10 along each lateral edge thereof by a generally L-shaped angle iron channel 24. The bed frame 22 is supported near the foot end of the box spring 12 by a leg 26 secured on each side of the bed frame 22 to the angle iron channel 24. The bed frame 22 includes a headboard 28 which is positioned at the head end of the box spring 12. The headboard 28 includes a pair of headboard posts 30 to which the angle iron channels 24 are connected to support the bed frame 22 at the head end thereof.

The triple beam frame 10 of the present invention is constructed in three layers. The bottom most layer of the frame 10 includes a pair of spaced generally parallel wooden side rails 32 extending lengthwise in the frame 10 along each outermost lateral edge thereof. The outermost bottom edge of each side rail 32 is supported in the angle iron channel 24 of the bed frame 22 to thereby support the box spring assembly 12. In a presently preferred embodiment of the triple beam frame 10, each side rail 32 is constructed of a single wooden board, one-inch by three-inches in cross section.

Extending between corresponding longitudinal ends of the side rails 32 and generally perpendicular thereto is a double thickness wooden end rail 34 positioned at each longitudinal end of the bed frame 10. The end rail 34 is preferably constructed of a lower board 35 in the bottom layer of the frame and underlying an upper board 37. Also included in the bottom layer of the triple beam frame 10 is a center support rail 36 extending longitudinally between the end rails 34 generally equal distance between the side rails 32. The center support rail 36 is parallel to the side rails 32 and perpendicular to the end rails 34 in the bottom layer of the triple beam frame 10 and is preferably constructed of a wooden board, one inch by two-inches in cross-section.

The middle layer of the triple beam frame 10 includes end rail upper board 37 extending transversely at each longitudinal end of the box spring assembly 12. Each end rail upper board 37 rests on the end rail lower board 35 but is longer to extend to each outside lateral edge of the frame 10. Each end rail upper board 37 is preferably constructed of a single wooden board one- inch by three-inches in cross-section; whereas, each end rail lower board 35 is preferably constructed of a single wooden board one-inch by one and a quarter inch in cross-section. In a presently preferred embodiment of the triple beam frame 10, each end of the end rail upper board 37 and side rail 32 is rounded to a two and a half inch radius forming corners 40 of the box spring assembly 12. The corners 40 of the box spring 12 are preferably rounded to avoid any sharp points or edges which may puncture or tear the upholstery covering on the box spring assembly 12 or provide a source of injury to one who contacts the corner region of the box spring assembly.

In a first embodiment of the triple beam frame 10 as shown in FIG. 1, three transverse wooden slats 42 extend laterally in the middle layer of the triple beam frame 10 and are equally spaced between the end rails 34. The transverse slats 42 provide the lateral support at the box spring assembly side edges and are each preferably constructed of a single wooden board one-inch by two-inches in cross-section. Each end of each transverse slat 42 is offset, preferably three-eighths of an inch, from the outermost side edge of the side rail 32 underlying the transverse slat 42. The transverse slats 42 are positioned orthogonally to the side rails 32 and center support rail 36 and parallel to the end rails 34 and in the middle layer of the frame 10.

The top layer of the triple beam frame 10 consists of eight spaced longitudinal slats 44 extending lengthwise in the frame 10 and positioned atop and perpendicular to the transverse slats 42 and end rails 34. Each longitudinal slat 44 is preferably constructed of a single one-inch by two-inch wooden board and each end of the cross slat 44 is offset, preferably three-eighths of an inch, from the outermost lengthwise edge of the underlying end rail upper board 37. The longitudinal slats 44 provide the additional lengthwise support to each end of the box spring assembly 12. Specifically, the longitudinal slats 44 offer added support to a portion of the triple beam frame 10 at the foot end of the box spring assembly 12 extending beyond the foot end of the Hollywood bed frame 22. The added lengthwise support offered by the longitudinal slats 44 enables one to sit at the foot end of the bed without the deformation or bending associated with box springs having only lateral slats. Furthermore, the box spring and mattress combination including the longitudinal slats 44 will be less likely to deflect or tip at the foot end unsupported by the Hollywood bed frame 22.

The lower end of each coil spring 14 is nailed, stapled, or otherwise secured to the top face of the longitudinal slats 44. The frame members 10 of the triple beam frame of the present invention are secured to one another as by nails, staples, screws or other conventional fasteners.

Figure 2:
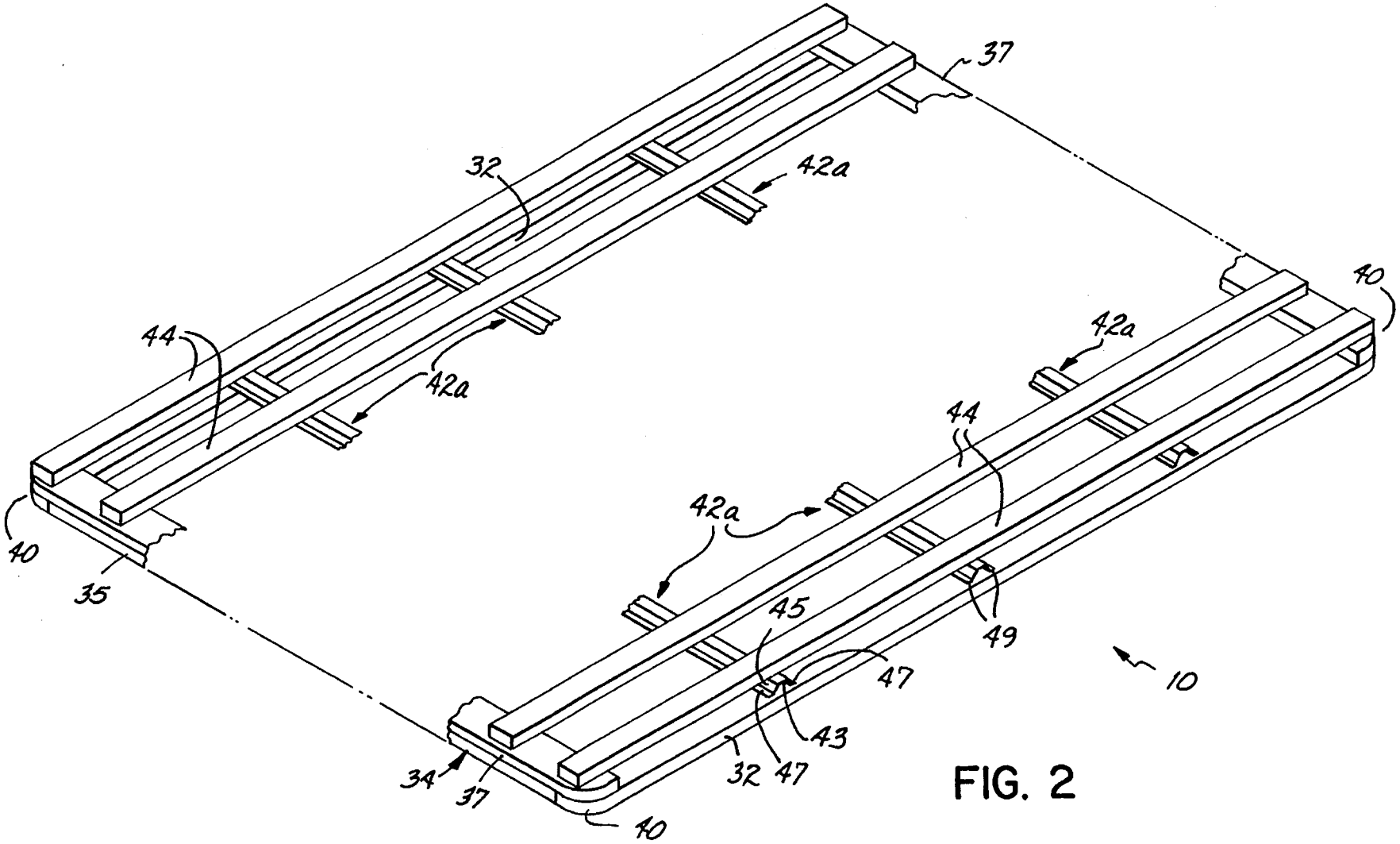
FIG. 2 is a partial perspective view of a second embodiment of the present invention in which the triple beam frame includes metal transverse slats.

A second preferred embodiment of the present invention is shown in FIG. 2. The triple beam frame 10 shown in FIG. 2 includes all of the same components and elements as the first embodiment shown in FIG. 1; however, metal channels have been included as the transverse slats **42*a*. The metal channel transverse slats 42*a* each have a generally planar upper surface 43 with a downwardly depending rib 45 on each side edge of the upper surface 43. A flange 47 is formed onto each rib 45 and the flanges 47, 47 on each transverse slat 42*a* form a pair of spaced generally planar lower surfaces 49 on the transverse slat 42***a*. The metal transverse slats 42*a* provide added strength and rigidity to the frame 10 while offering a more lightweight frame and box spring relative to an all wooden frame.

In another embodiment of the present invention, the transverse slats 42 or 42*a* are manufactured from a composite material or from fibers embedded within a resin matrix. Composite transverse slats offer sufficient structural integrity and rigidity with a reduction in weight as compared to wooden slats.

From the above disclosure of the general principals of the present invention and the preceding detailed description of preferred embodiments, those skilled in the art will readily comprehend the various modifications to which the present invention is susceptible. For example, the invention has been shown and described with reference to particular materials and number of slats and beams, but it is readily within the scope of this invention to vary from these materials or structure. Therefore, we desire to be limited only by the scope of the following claims and equivalents thereof:

We claim:

1. A rectangular frame for a box spring assembly for use in supporting a bedding mattress, the frame comprising:

a pair of spaced generally parallel wooden side rails, each said side rail comprising a single wooden board having opposite ends and being in a bottom plane of the frame;

a pair of spaced generally double board thickness parallel wooden end rails, each said end rail extending between corresponding ends of said side rails and each end rail comprising a lower end rail board located in the bottom plane of the frame and an upper end rail board resting atop said lower end rail board, and one of said opposite ends of each of said side rail boards underlying an end of each said upper end rail board;

a plurality of spaced generally parallel transverse slats resting atop said side rails, said transverse slats extending laterally across the box spring assembly intermediate said side rails; and a plurality of spaced generally parallel wooden longitudinal slats resting atop and perpendicular to said transverse slats and said end rails in a top plane of the frame, said longitudinal slats extending lengthwise of the box spring assembly.

2. The frame of claim 1 wherein said transverse slats are constructed from one of the set of materials including wood and metal.

3. The frame of claim 1 wherein said side rails, said upper and lower boards of said end rails, said transverse slats, and said longitudinal slats are each rectangular in cross section having upper and lower faces wider than side edges thereof.

4. The frame of claim 3 wherein said lower face of said upper board end rail is in face to face juxtaposition with said upper face of said lower board end rail.

5. The frame of claim 4 wherein said upper face of an end portion of each said side rail is in face to face juxtaposition with said lower face of said upper board end rail, said upper face of said side rail is in face to face juxtaposition with said lower face of an end portion of each said transverse slat, and said lower face of each said longitudinal slat is in face to face juxtaposition with said upper face of said transverse slat and said upper face of said upper board end rail.

6. The frame of claim 1 wherein an end of each said lower end rail board is in juxtaposition against a side edge of said side rail.

7. The frame of claim 1 further comprising:

a wooden center support rail extending between and parallel to said side rails and underlying said transverse slats in said bottom plane of the frame.

8. The frame of claim 1 wherein an end of each said transverse slat is offset from an edge of said side rail and an end of each said longitudinal slat is offset from an edge of said end rail.

9. The frame of claim 1 wherein said transverse slats are metal channels.

10. The frame of claim 9 wherein said metal channel transverse slats have a generally planar upper surface in juxtaposition with a lower face of said longitudinal slats and a pair of spaced generally planar lower surfaces in juxtaposition with an upper face of said side rails.

11. The frame of claim 1 wherein said transverse slats are composite channels formed from fibers embedded within a resin matrix.

* * * * *